US007409930B2

(12) United States Patent
Nagashima et al.

(10) Patent No.: US 7,409,930 B2
(45) Date of Patent: Aug. 12, 2008

(54) WATER COOLING DEVICE FOR OUTBOARD MOTOR

(75) Inventors: Mitsuru Nagashima, Shizuoka-ken (JP); Masanori Takahashi, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/350,349

(22) Filed: Feb. 8, 2006

(65) Prior Publication Data

US 2006/0175039 A1 Aug. 10, 2006

(30) Foreign Application Priority Data

Feb. 8, 2005 (JP) ..... 2005-031421

(51) Int. Cl.
*F01P 11/08* (2006.01)
*F01M 5/00* (2006.01)

(52) U.S. Cl. ..... 123/41.33; 123/196 AB; 440/88 C

(58) Field of Classification Search ..... 123/41.33, 123/196 AB, 196 W; 440/88 R, 88 L, 88 C
See application file for complete search history.

(56) References Cited

U.S. PATENT DOCUMENTS 3,493,081 A * 2/1970 Tado ..... 440/88 R
5,876,256 A * 3/1999 Takahashi et al. ..... 440/88 L

FOREIGN PATENT DOCUMENTS

JP 09-189224 7/1997
JP 2000-062694 2/2000

* cited by examiner

*Primary Examiner*—Noah Kamen
(74) *Attorney, Agent, or Firm*—Knobbe, Martens, Olson & Bear, LLP

(57) ABSTRACT

An outboard motor can have a case supported by a hull, an internal combustion engine supported on the upper end of the case, an oil pan formed in the case for storing lubricating oil for the internal combustion engine, and a cooling water jacket formed integrally with the oil pan. A cooling water passage for communicating the cooling water jacket with the internal combustion engine is provided. The cooling water jacket can be formed on the bottom of the oil pan. Optionally, a space can be formed between at least a part of the outer wall of the oil pan and the cooling water passage.

9 Claims, 9 Drawing Sheets

WATER COOLING DEVICE FOR OUTBOARD MOTOR

PRIORITY INFORMATION

This application is based on and claims priority to Japanese Patent Application No. 2005-031421, filed Feb. 8, 2005, the entire contents of which is hereby expressly incorporated by reference.

BACKGROUND OF THE INVENTIONS

1. Field of the Inventions

The present inventions relate to a water cooling device for an outboard motor, and more particularly, outboard motors with cooling water jackets formed on an oil pan for an internal combustion engine and a cooling water passage for connecting the cooling water jacket with the internal combustion engine.

2. Description of the Related Art

One type of outboard motor is disclosed in Japanese Patent Documents JP-A-Hei9-189224 and JP-A-2000-62694. In each of these Patent Documents, the outboard motors have a case supported by a hull of a watercraft, an internal combustion engine supported on the upper end of the case, an oil pan formed in the case for storing lubricating oil for the internal combustion engine, and a cooling water jacket formed integrally with the oil pan. A cooling water passage connects the cooling water jacket with the internal combustion engine.

When the internal combustion engine is driven, the lubricating oil in the oil pan is supplied to the internal combustion engine to lubricate the parts of the internal combustion engine. The internal combustion engine can be thereby, continuously driven smoothly.

When the internal combustion engine is driven, cooling water is supplied into the cooling water jacket of the oil pan and the cooling water is supplied to the internal combustion engine. Then, the lubricating oil in the oil pan is cooled by the cooling water, thereby preventing deterioration of the lubricating oil, and the internal combustion engine is also cooled to prevent a temperature rise thereof.

In the above-noted outboard motor designs, a large amount of the lubricating oil stored in the oil pan is supplied to the internal combustion engine when the internal combustion engine is being driven. Thus, the level of the lubricating oil in the oil pan is near the bottom of the oil pan. As a result, less lubricating oil remains in the upper part of the oil pan, and thus the upper part of the oil pan can remain empty. The oil pan is cooled along its entire length in the vertical direction by at least either the cooling water jacket or the cooling water passage.

SUMMARY OF THE INVENTION

In general, when the above-noted internal combustion engines are being driven, less lubricating oil remains in the upper part of the oil pan and thus the upper portion of the oil pan is largely filled only with blow-by gases from the internal combustion engine. The oil pan, including the upper part thereof, is entirely cooled by the cooling water.

An aspect of at least one of the embodiments disclosed herein includes the realization that, in outboard motors such as those noted above, the temperature of the upper part of the oil pan, which can be empty during operation, is lowered by the cooling jacket, and moisture contained in the blow-by gas tends to condense on the inner surface of the upper part of the oil pan which can cause oil slurry. When the slurry is mixed into the lubricating oil in the oil pan, the viscosity of the lubricating oil is increased and thus the internal combustion engine may not be adequately lubricated.

Thus, in accordance with an embodiment, a water cooling device for an outboard motor can comprise a case configured to be supported by a hull, an internal combustion engine supported on an upper end of the case and an oil pan formed in the case for storing lubricating oil for the internal combustion engine. A cooling water jacket can be disposed in thermal communication with the oil pan and a cooling water passage can be provided for communicating the cooling water jacket with the internal combustion engine. The cooling water jacket can be formed on the bottom of the oil pan and a space can be formed between at least a part of an outer wall of the oil pan and the cooling water passage.

In accordance with another embodiment, a water cooling device for an outboard motor can comprise a case configured to be supported by a hull, an internal combustion engine supported on an upper end of the case and an oil pan formed in the case for storing lubricating oil for the internal combustion engine. The water cooling device can also include means for cooling lubricating oil in the oil pan and reducing condensation of water vapor in blow by gases in the oil pan.

In accordance with yet another embodiment, a water cooling device for an outboard motor can comprise a case configured to be supported by a hull, an internal combustion engine supported on an upper end of the case and an oil pan formed in the case for storing lubricating oil for the internal combustion engine. The water cooling device can also include means for liquid-cooling only the bottom of the oil pan.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

The embodiments of a cooling water device are described below in the context of an outboard motor because they have particular utility in this context. However, the cooling water devices disclosed herein can be used in other contexts in which a lubrication reservoir is cooled, such as in other marine engines in other watercraft, as well as land vehicles. The cooling water devices disclosed herein are configured to cool an oil pan for storing the lubricating oil in order to prevent deterioration of the lubricating oil and to ensure that the internal combustion engine can be adequately lubricated by the lubricating oil.

Figure 2:
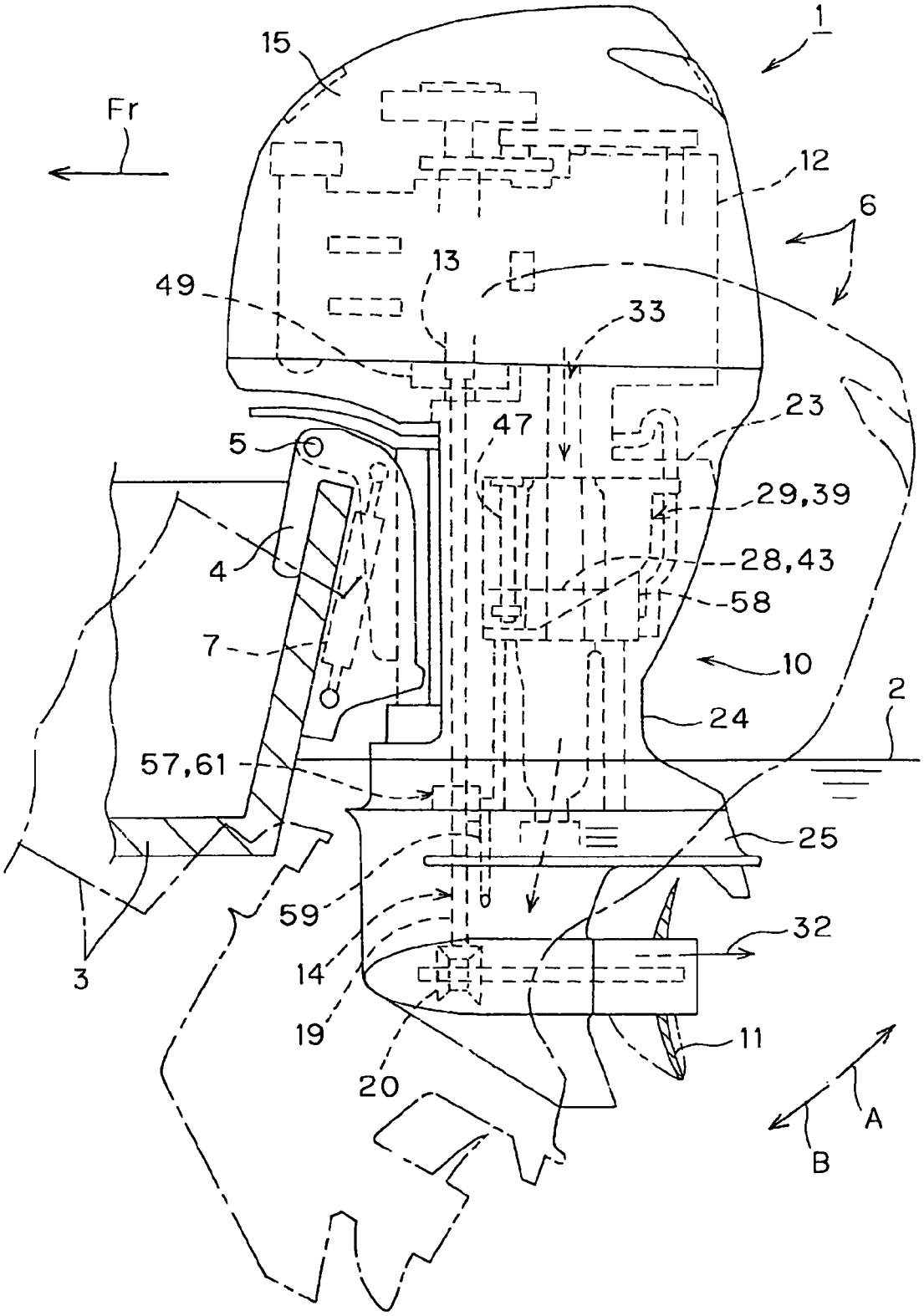
FIG. 2 shows the first embodiment, illustrating an entire side view of the outboard motor.

In the drawings, with initial reference to FIG. 2, a small watercraft 1 includes a hull 3 configured for floating on the surface of water 2. A clamp bracket 4 is attached to the rear end of the hull 3. An outboard motor 6 is supported on the rear end of the hull 3 via the clamp bracket 4 and a pivot member 5 supported by the clamp bracket 4. A hydraulic actuator 7 allows the lower part of the outboard motor 6 to tilt up A and down B backward and upward about the pivot member 5 (as indicated by solid lines in the drawings). The arrow Fr in each drawing indicates the forward direction in which the watercraft 1 travels.

The outboard motor 6 can have an aluminum casting case 10 forming the outer shell of the outboard motor 6. A propeller 11 can be rotatably supported by the lower end of the case 10. An internal combustion engine 12 can be supported on the upper end of the case 10. A power transmission device 14 can operatively connect a crankshaft 13 of the internal combustion engine 12 to the propeller 11. Additionally, a cowling 15 can cover the internal combustion engine 12 from outside. The case 10 can be vertically elongated and can be pivoted at its upper part by the clamp bracket 4 via the pivot member 5. The power transmission device 14 can be housed in the case 10. A lower part of the case 10 and the propeller 11 can be submerged under the water 2 during normal operation.

The crankshaft 13 can have an axis 18 extending generally vertically. The power transmission device 14 can have a power transmission shaft 19 extending generally vertically along the axis 18 of the crankshaft 13, and a gear set 20 can be included for operatively connecting the propeller 11 to the lower end of the power transmission shaft 19. The upper end of the power transmission shaft 19 can be operatively connected to the crankshaft 13.

The case 10 can have a guide exhaust 23 for supporting the internal combustion engine 12 on its upper surface. An upper case 24 can be attached to a lower surface of the guide exhaust 23. A lower case 25 can be attached to a lower surface of the upper case 24 and an oil pan 29 can be used for storing lubricating oil 28 for the internal combustion engine 12. A partition 31 can be joined to a lower end surface 30 of the oil pan 29.

The guide exhaust 23 can form the top part of the case 10. The upper case 24 forms a longitudinal intermediate portion of the case 10. The lower case 25 forms a lower part of the case 10.

The oil pan 29 can be formed in the case 10 and can be disposed on the upper side in the upper case 24. The upper case 24 and the oil pan 24 can be formed separately. The oil pan 29 can have an upper end surface 26 which can be joined to a lower surface of the guide exhaust 23 and secured to the guide exhaust 23 by fasteners 27. The lubricating oil 28 can be stored on the inside bottom side of the oil pan 29.

With additional reference to FIG. 2, an exhaust,device 33 can be provided for discharging exhaust gas 32 exhausted from the internal combustion engine 12 into the water 2 when the internal combustion engine 12 can be being driven. The exhaust device 33 can include an exhaust pipe 34 extending generally vertically in an upper part of the upper case 24. The upper end of the exhaust pipe 34 can be fastened to the guide exhaust 23 together with the oil pan 29 by the fasteners 27.

The lower end of the exhaust pipe 34 can extend downwardly through the partition 31. A muffler 35 can extend generally vertically in a lower part of the upper case 24. The upper end of the muffler 35 can be attached to the lower surface of the partition 31 and can communicate with the exhaust pipe 34. The lower end of the muffler 35 can be connected to the lower case 25.

An upstream exhaust passage 36 for connecting an exhaust passage of the internal combustion engine 12 with the upper end of the exhaust pipe 34 can be formed through the guide exhaust 23 and the oil pan 29. A downstream exhaust passage 37 for connecting the lower end of the muffler 35 into the water 2 can be formed in the lower case 25.

The lubricating oil 28 and the oil pan 29 can form a lubricating device 39 for lubricating the parts of the internal combustion engine 12. The lubricating device 39 can include the oil pan 29 which can have a cup-shaped oil pan body 40 which opens upwardly.

An outward flange 41 can be formed integrally with an upper end part of the oil pan body 40, and a bulged portion 42 can be formed by bulging the center part of the bottom of the oil pan body 40 upwardly. In this configuration, the oil pan body 40 is roughly doughnut-shaped. Other configurations can also be used.

The space between the inner peripheral surface of the oil pan body 40 and the outer peripheral surface of the bulged portion 42 can be an oil storage section 43 for storing the lubricating oil 28. The bulged portion 42 can have a rectangular shape as viewed in a plan view, and can have a flat outer front side extending in the transverse direction of the watercraft 1.

The upper end surface of the bulged portion 42 can form a part of the upper end surface 26 of the oil pan 29, and can be joined to the lower surface of the guide exhaust 23 and secured thereto by the fasteners 27. A part of the upstream exhaust passage 36 can be formed through the upper end part of the bulged portion 42. The exhaust pipe 34 extends through the bulged portion 42, and the upper end of the exhaust pipe 34 and the upper end of the bulged portion 42 are fastened together to the guide exhaust 23 by the fasteners 27.

The lubricating device 39 can have an oil pipe 47 extending generally vertically. The oil pan 29 can be deepest at the front end. A first end 44 of the oil pipe 47, which can be the lower end thereof, opens at the lower front end in the oil pan 29. A second end 45 of the oil pipe 47, which can be the upper end thereof, extends toward the internal combustion engine 12 through an oil passage 46 formed through the guide exhaust 23.

The lubricating device 39 can also include a strainer 48 provided in the first end 44 of the oil pipe 47, and an oil pump 49 which can be driven to supply the lubricating oil 28 in the oil pan 29 to the internal combustion engine 12. The first end 44 of the oil pipe 47 and the strainer 48 can be located between the front side of the oil pan body 40 and the outer front side of the bulged portion 42 in the longitudinal direction of the watercraft 1.

When the oil pump 49 is driven, it draws the lubricating oil 28 through the first end 44 of the oil pipe 47 and discharges the oil through the second end 45 of the oil pipe 47. The discharged lubricating oil 28 can be supplied to the internal combustion engine 12 to lubricate the moving parts disposed therein.

The power transmission shaft 19 of the power transmission device 14 can be located at the front end in the case 40 and in front of the oil pan 29. The oil pump 49 has a rotor located on the common axis 18 of the crankshaft 13 and the power transmission shaft 19 and operatively connected to the crankshaft 13. At least part of the oil pump 49 can be located in front of the oil pan 29. The oil pump 49 can be located between the internal combustion engine 12 and the guide exhaust 23 in the vertical direction.

A first part 51 of the inside bottom surface of the oil pan 29, which can be located below the first end 44 of the oil pan 47, forms the deepest part of the oil pan 29. The first end 44 of the oil pipe 47 opens above and generally in the vicinity of the first part 51. A second part 52 of the inside bottom surface of the oil pan 29, which can be located behind the first part 51, can be formed higher than the first part 51. As such, this configuration helps the liquid lubricating oil collect in the first part 51, which is also where the first end 44 is disposed.

For example, the first part 51, which forms the front end part of the inside bottom of the oil pan 29, has a flat-plate like shape and extends generally horizontally. The rear end of the first part 51 can be located in front of the middle of the oil pan 29 and in generally the same position as the front end of the bulged portion 42 in the longitudinal direction of the watercraft 1. The second part 52 has a flat-plate like shape and extends obliquely upwardly and rearwardly from the rear end of the first part 51.

A drain hole. 53 for allowing the lubricating oil. 28 at the deepest part of the inside of the oil pan 29 to be drained to the outside of the case 10 can be formed through the case 10 and the oil pan 29.

Every part of the upper surface 26 of the oil pan 29, including the upper end surface of the bulged portion 42, can be located on a virtual plane 54 extending generally horizontally. Every part of the lower end surface 30 of the oil pap 29 below the first part 51, and the second part 52 of the inside bottom surface of the oil pan 29 can be located on another virtual plane 55 extending parallel to the virtual plane 54 and generally horizontally.

A water cooling device 57 for cooling the internal combustion engine 12 and the lubricating oil 28 can also be provided.

The water cooling device 57 can have a cooling water jacket 58 formed in conjunction with the partition 31. In some embodiments, the cooling water jacket 8 is only in thermal communication with the bottom of the oil pan 29. A water pump 61 for supplying the water 2 as cooling water 60 to the front end of the cooling water jacket 58 through a cooling water passage 59 can be formed in the case 10.

The water pump 61 can have a rotor located on the common axis 18 of the crankshaft 13 and the power transmission shaft 19 and operatively connected to the crankshaft 13. The water pump 61 can be located in front of the oil pan 29 and disposed at the lower end in the upper case 24.

Figure 3:
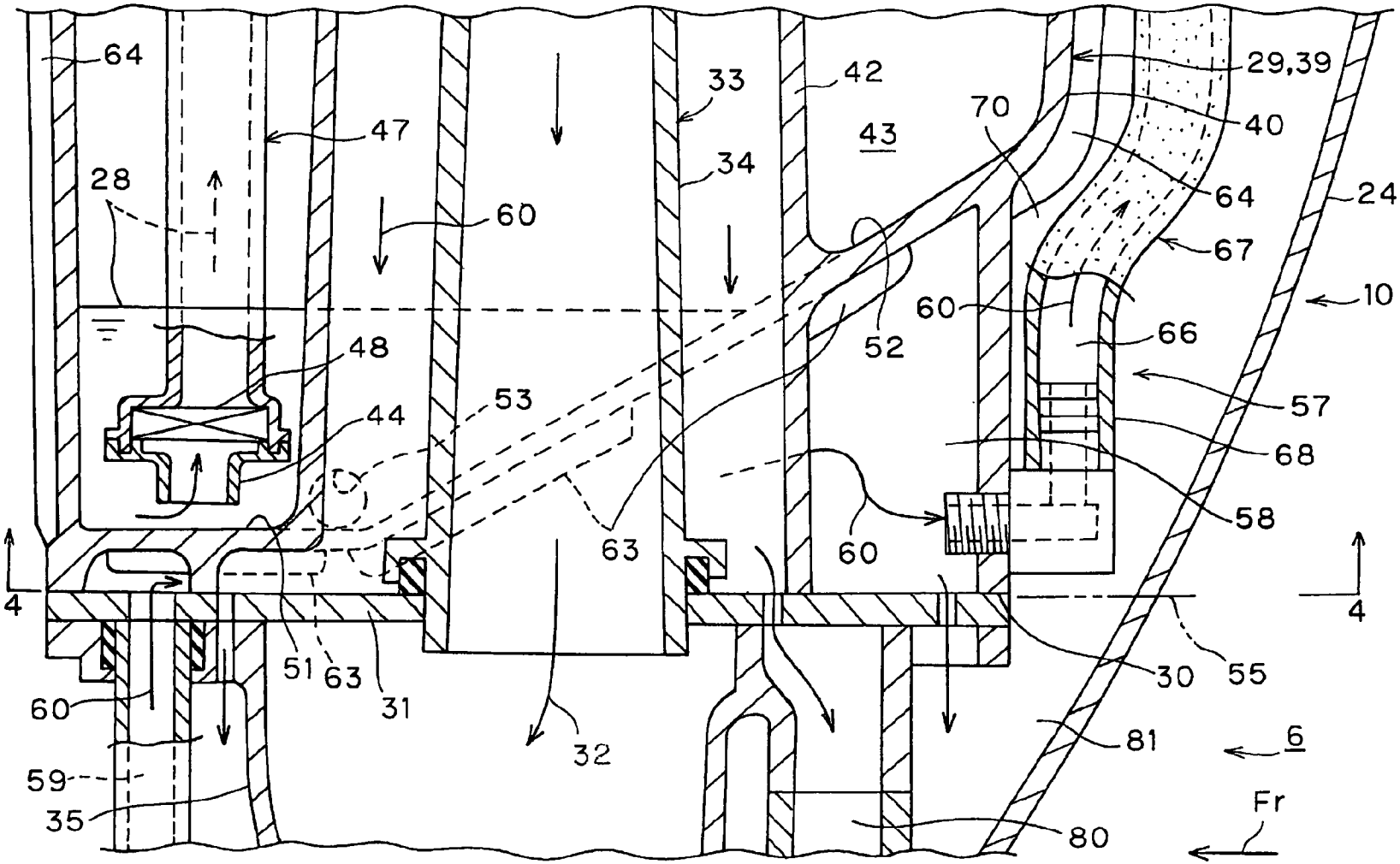
FIG. 3 shows the first embodiment, illustrating a partial enlarged view of FIG. 1.
Figure 4:
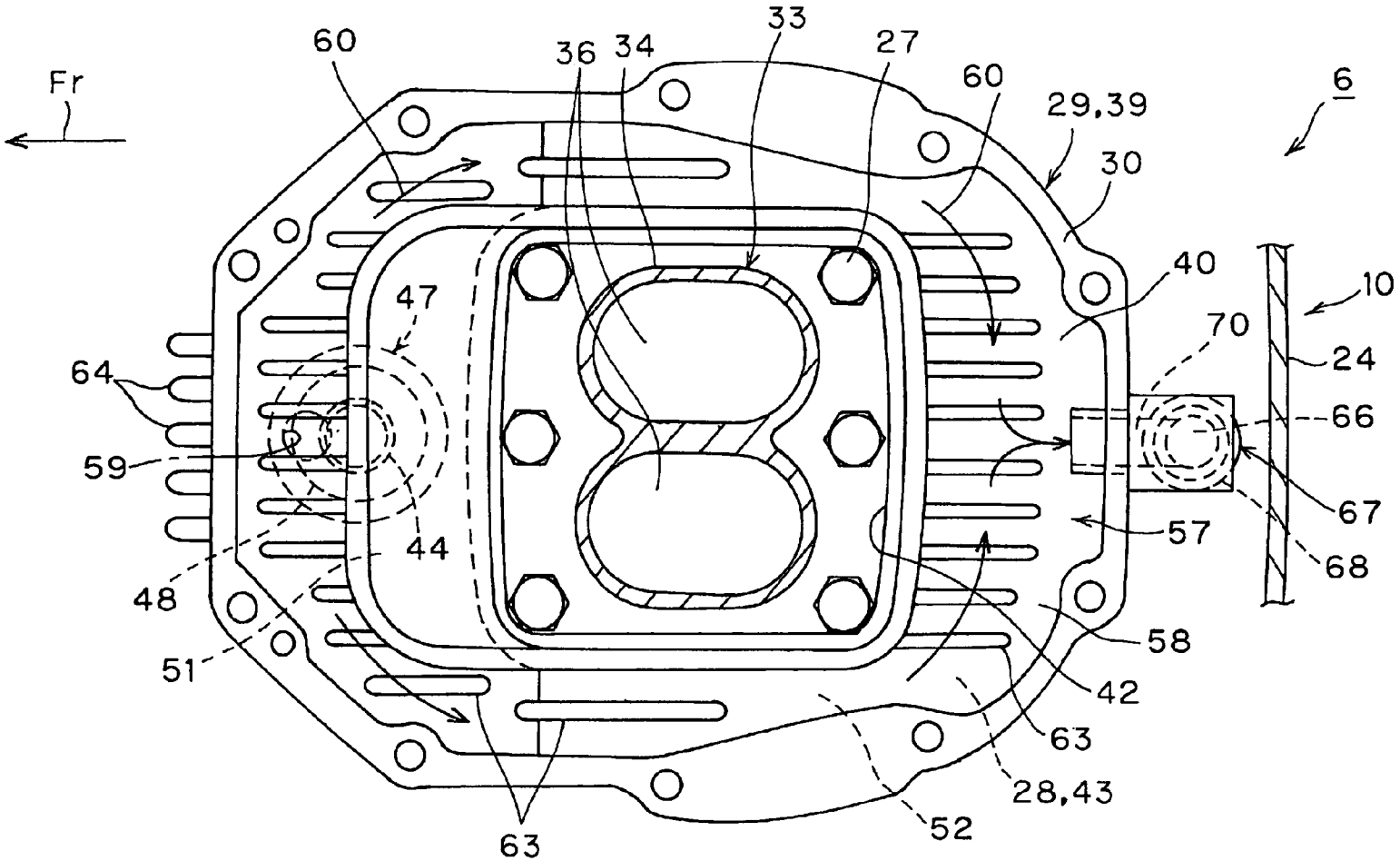
FIG. 4 shows the first embodiment, illustrating a cross-sectional view taken along the line 4-4 in FIG. 3.

With additional reference to FIG. 3, the water cooling device 57 can also have a plurality of cooling fins 63 formed integrally with the lower side of the bottom of the oil pan 29. The cooling fins 63 can be disposed inside the cooling water jacket 58. The cooling fins 63 can extend in the longitudinal direction of the hull 3.

A plurality of cooling fins 64 can also be formed integrally with the front and rear sides of the oil pan 29. The cooling fins 64 can extend vertically. The cooling fins 63 and 64 are arranged at generally equal intervals in the transverse direction of the hull 3.

A cooling water passage 66 for communicating the cooling water jacket 58 with the internal combustion engine 12 can be formed in the upper case 24 of the case 10. The cooling water passage 66 can be defined by a flexible rubber tube 67. However, other configurations can also be used.

A first end 68 of the tube 67 can be removably connected to a lower rear end part of the oil pan 29 by a joint and communicated with a rear end part of the cooling water jacket 58. A second end 69 of the tube 67 can be removably connected to a rear end part of the outward flange 41 as an upper end of the oil pan 29 by a joint.

Between the oil storage section 43 of the oil pan 29 and the cooling water passage 66 in the tube 67, a space 70 can be formed along the almost entire length of the tube 67. More specifically, the space 70 can be formed between at least an upper part of the outer wall of the oil pan 29 and the cooling water passage 66 in the tube 67. In other words, the surface of the outer wall of the oil pan 29 facing the space 70 and the tube 67 are spaced apart from each other with the space 70 therebetween. The tube 67 can be located behind the oil pan 29.

A second cooling water passage 71 for connecting the second end 69 of the tube 67 with the internal combustion engine 12 can also be provided. The second cooling water passage 71 can be defined in a second flexible rubber tube 72. A first end 73 of the second tube 72 can be removably connected to a part of the guide exhaust 23 by a joint and a second end 74 of the second tube 72 can be removably connected to another part of the guide exhaust 23 by a joint.

Figure 1:
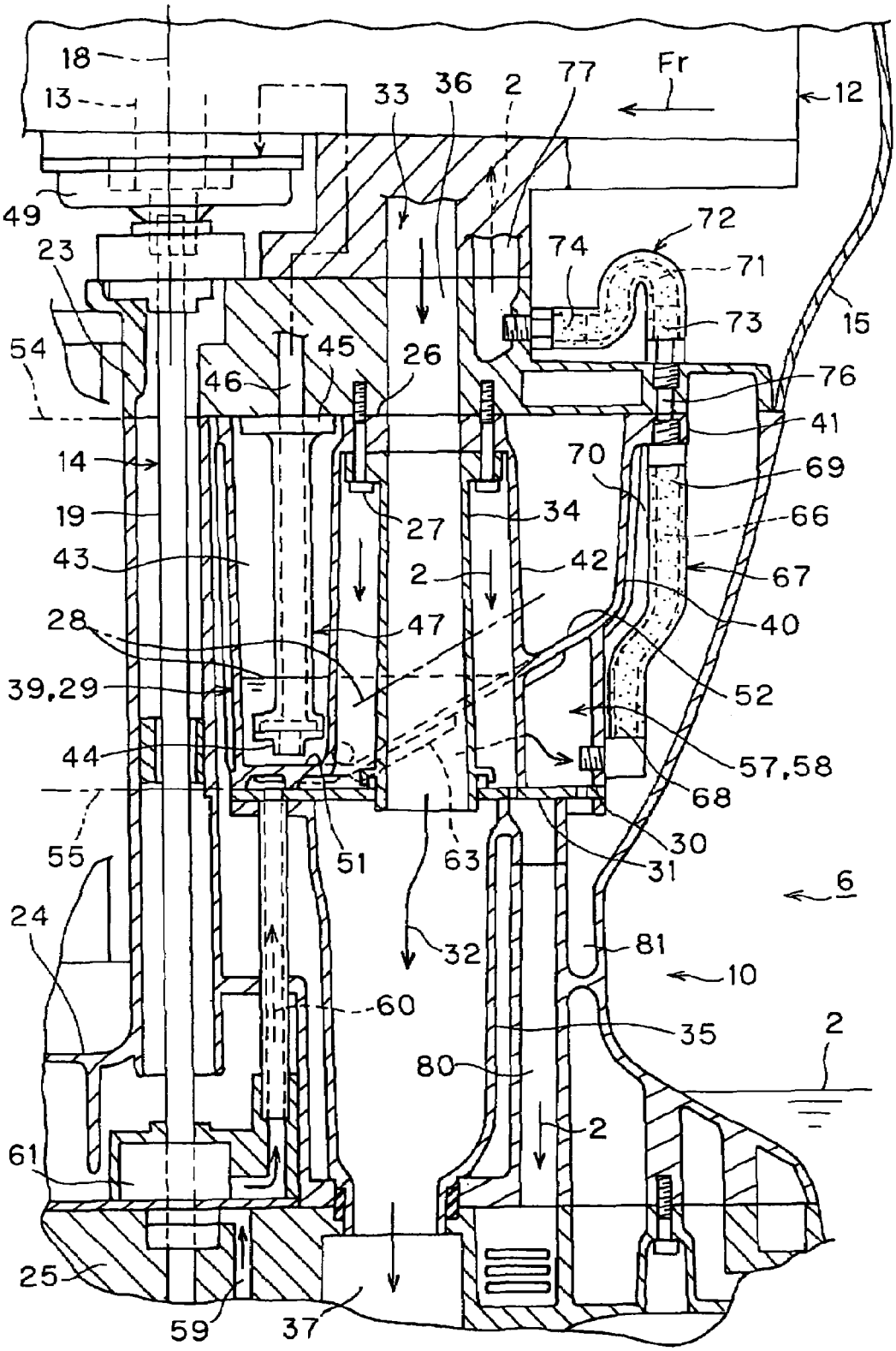
FIG. 1 shows a first embodiment, illustrating a partial enlarged and sectional view of the outboard motor of FIG. 2.
Figure 5:
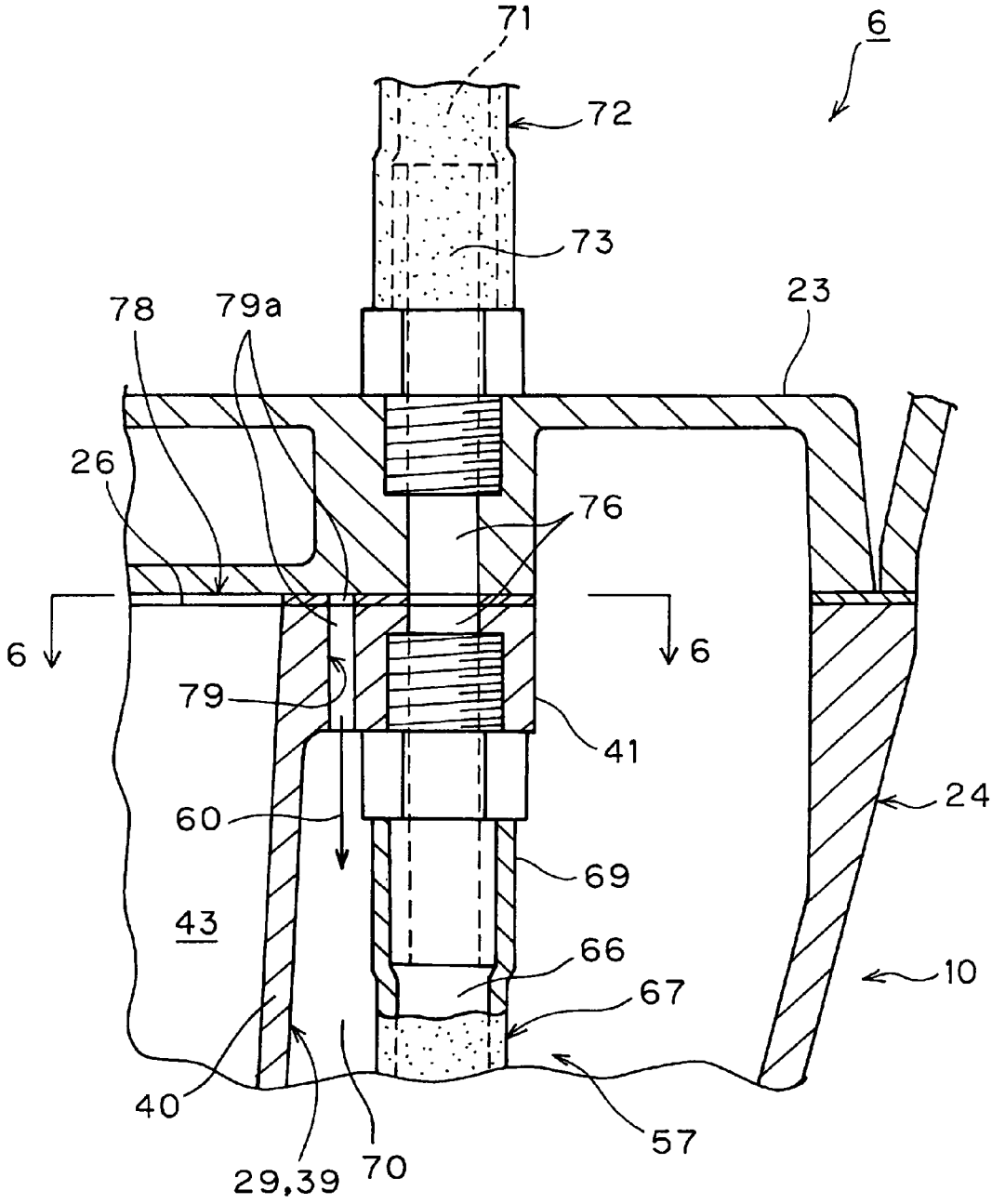
FIG. 5 shows the first embodiment, illustrating a partial enlarged view of FIG. 1.
Figure 6:
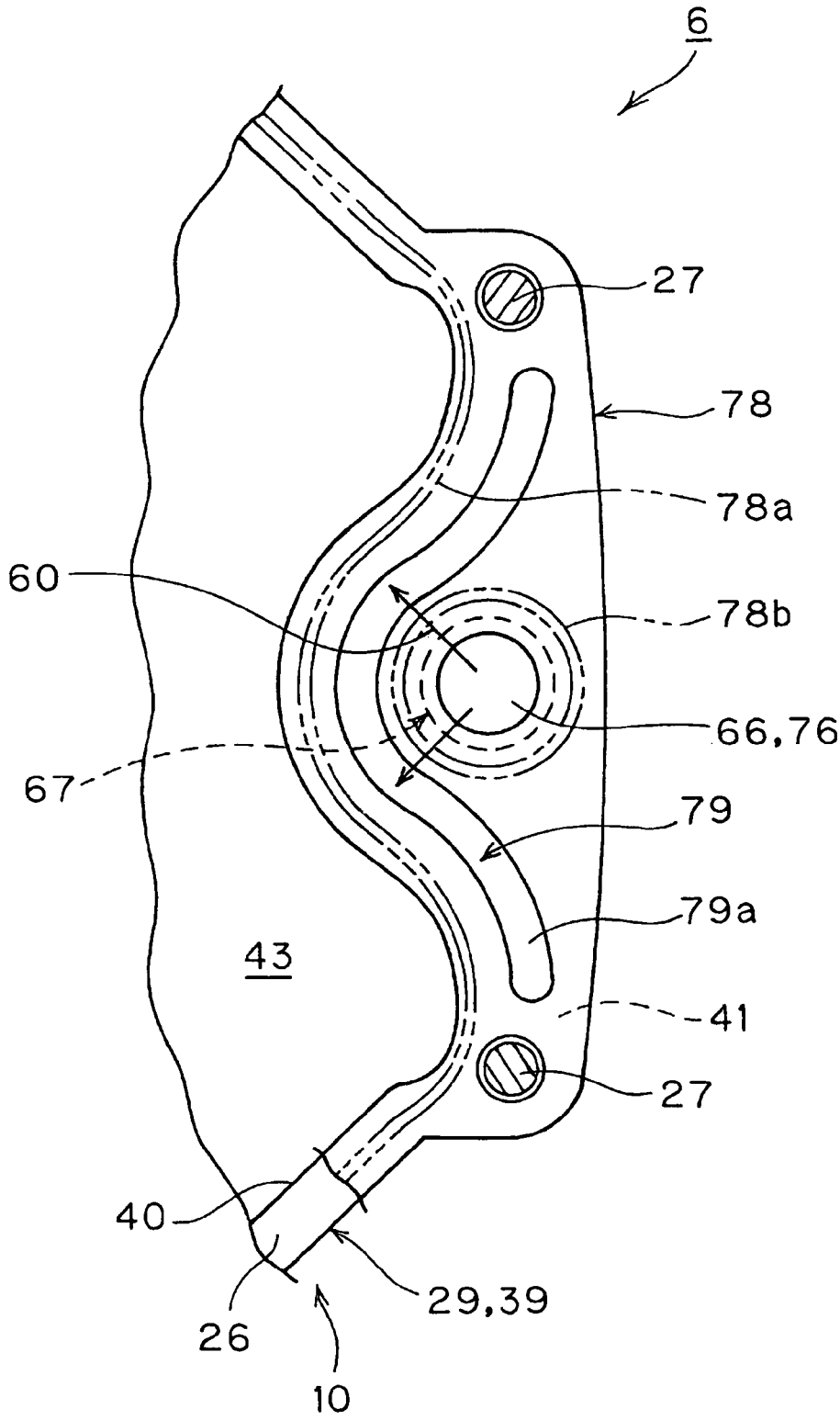
FIG. 6 shows the first embodiment, illustrating a cross-sectional view taken along the line 6-6 in FIG. 5.

As shown in FIGS. 1, 5 and 6, a communication passage 76 can be formed across an upper end part of the oil pan 29 and the guide exhaust 23. The communication passage 76 connects the upper end of the cooling water passage 66 in the second end 69 of the tube 67 with the second cooling water passage 71 in the first end 73 of the second tube 72. The second cooling water passage 71 in the second end 74 of the second tube 72 can be connected with a cooling water jacket (not shown) formed in the internal combustion engine 12 through a second communication passage 77 formed in the guide exhaust 23 and the internal combustion engine 12.

A metal gasket 78 can be interposed between the mating faces of the guide exhaust 23 and the oil pan 29. The gasket 78 has first and second beads 78*a* and 78*b* protruded upward in the form of an arc. The first bead 78*a* can be formed around the oil storage section 43 and the second bead 78*b* can be formed around the communication passage 76 as viewed in a plan view of the outboard motor 6.

According to this configuration, there are two beads, that can be, the first and second beads 78*a* and 78*b*, in the route from the communication passage 76 to the oil storage section 43 of the oil pan 29 between the mating faces. Even if the cooling water 60 flowing through the communication passage 76 leaks from the communication passage 76 into the gap between the mating faces of the guide exhaust 23 and the oil pan 29 because of corrosion or damage, the first and second beads 78*a* and 78*b* prevent the leaked cooling water 60 from flowing into the oil storage section 43. Thus, the cooling water 60 can be prevented from mixing into the lubricating oil 28 in the oil storage section 43.

Also, a water guide passage 79 for guiding the cooling water 60 leaked from the communication passage 76 as described above to the outside of the oil pan 29 can be formed in at least one of the mating faces.

More specifically, water guide holes 79*a* forming the water guide passage 79 are formed through the parts of the outward flange 41 and the gasket 78 radially outside and in the vicinity of the communication passage 76 in such a manner that they look like surrounding the communication passage 76 as seen from the oil storage section 43 side. The water guide holes 79*a* are of the same size and shape and located at the same position as viewed in a plan view, and extend vertically through the parts of the outward flange 41 and the gasket 78. The water guide holes 79*a* are located between the first and second beads 78*a* and 78*b* as viewed in a plan view (FIG. 6). The water guide holes 79*a* may be formed inside the second bead 78*b*. The gasket 78 may not have the water guide hole 79*a*.

The cooling water 60 in the second communication passage 77 can be circulated in the cooling water jacket of the internal combustion engine 12 to cool the internal combustion engine 12. A water discharge passage 80 can be provided for discharging the cooling water 60 having been used to cool the internal combustion engine 12 into the water 2. The water discharge passage 80 extends between the outer surface of the exhaust pipe 34 and the inner surface of the bulged portion 42 of the oil pan 29 and through the partition 31, the muffler 35, the upper case 24 and the lower case 25 in sequence. The space between the inner surface of the upper case 24 and the outer surfaces of the oil pan 29 and the muffler 35 define a second water discharge passage 81 for discharging cooling water 60 discharged into this space into the water 2.

When the internal combustion engine 12 is driven, the propeller 11 can be driven via the power transmission device 14 and the watercraft 1 can be propelled. The exhaust gas 32 from the internal combustion engine 12 can be discharged into the water 2 through the upstream exhaust passage 36, the exhaust pipe 34, the muffler 35 and the downstream exhaust passage 37.

To increase the capacity of the oil pan 29, the elevation angle of the second part 52 of the inside bottom of the oil pan 29 toward the rear of the watercraft 1 can be preferably as small as possible. When the watercraft 1 is quickly accelerated while being propelled forward, the watercraft 1 can be tilted into a front lift position (as indicated by dot-dash lines in FIGS. 1 and 2). The maximum elevation angle of the watercraft 1 at the time when it can be tilted can be generally 25 to 35°. Thus, the elevation angle of the second part 52 of the oil pan 29 can be 20 to 40°, preferably 25 to 35°. In other words, the oil pan 29 can be formed in a shape which ensures that the lubricating oil 28 stays at the deepest part of the inside of the oil pan 29 when the watercraft 1 is tilted.

As a result, the oil pan 29 has a sufficiently large capacity. Also, the lubricating oil 28 in the oil pan 29 can be reliably drawn into the oil pump 49 through the oil pipe 47 and supplied to the internal combustion engine 12 even when the watercraft 1 is tilted.

When the internal combustion engine 12 driven, the oil pump 49 can also be driven. Then, the lubricating oil 28 in the oil pan 29 can be drawn through the first end 44 of the oil pipe 47 and supplied to the internal combustion engine 12 through the oil pile 47, the oil passage 46 and the oil pump 49 to lubricate the parts of the internal combustion engine 12. After that, the lubricating oil 28 can be returned to the oil pan 29 through a return passage (not shown).

When the internal combustion engine 12 is driven, the water pump 61 can also be driven. Then, the water 2 can be drawn into the water pump 61 through the cooling water passage 59 and supplied to the cooling water jacket 58 which, in some embodiments, is only in thermal communication with a bottom surface 52 of the oil pan body 40. The lubricating oil 28 can be thereby cooled via the oil pan 29 and deterioration of the lubricating oil 28 can be prevented.

The cooling water 60 having been used to cool the lubricating oil 28 and the oil pan 29 can be supplied to the cooling water jacket of the internal combustion engine 12 through the cooling water passage 66 in the tube 67, the communication passage 76, the second cooling water passage 71 in the second tube 72, and the second communication passage 77. The cooling water 60 can be circulated in the cooling water jacket to cool the internal combustion engine 12 and then discharged into the water 2 through the water discharge passage 80.

According to the above configuration, the cooling water jacket 58 can be formed on the bottom of the oil pan 29 and a space 70 can be formed between at least a part of an outer wall of the oil pan 29 and the cooling water passage 66.

Thus, the lubricating oil 28 can be cooled by the cooling water 60 flowing through the cooling water passage 66 via the bottom of the oil pan 29. Therefore, the upper portion of the oil pan body 40 is not cooled to the same extent as the bottom surface 52 of the oil pan body 40. As such, water vapor in the blow-by gases will not condense on the inner walls of the oil pan body 40 as quickly as the condensation forms in the prior art oil pans, the lateral walls of which are completely or substantially completely cooled with a cooling jacket. With less condensation, less oil sludge will form, and thus, the deterioration of the lubricating oil 28 can be slowed or prevented.

In addition, as described above, a space 70 can be formed between at least a part of the outer wall of the oil pan 29 and the cooling water passage 66. Thus, while the internal combustion engine 12 is being driven, the upper of the oil pan 29, which contains only a small amount of lubricating oil 28 or is empty, is prevented from being excessively cooled by the cooling water 60 flowing through the cooling water passage 66.

Therefore, moisture in the blow-by gas filled in the oil pan 29 is not condensed on the upper part of the oil pan 29 as quickly as in the prior art oil pan designs. In other words, generation of slurry caused by the condensation and mixing of the slurry into the lubricating oil 28 can be slowed or prevented. Therefore, an increase in viscosity of the lubricating oil 28 by the slurry can be prevented from occurring and the internal combustion engine 12 can be properly lubricated by the lubricating oil 28.

As described before, the power transmission shaft 19, the oil pump 49 and the water pump 61 can be located in front of the oil pan 29 and the cooling water passage 66 can be located behind the oil pan 29.

Thus, when the tube 67 defining the cooling water passage 66 and so on are assembled onto the oil pan 29, the power transmission shaft 19, the oil pump 49 and the water pump 61 do not hinder the assembling work. Therefore, since the assembly of the above parts can be accomplished easily, the water cooling device 57 can be assembled easily.

As described above, the cooling water passage 66 can be defined in the tube 67, and the first end 68 and the second end 69 of the tube 67 are connected to the cooling water jacket 58 and an upper end part of the oil pan 29, respectively.

When the cooling water passage 66 is formed in the oil pan 29, the oil pan must have a thick wall part to form the cooling water passage 66. However, since the cooling water passage 66 can be formed by a tube 67 separated from the oil pan 29, the oil pan 29 does not need such a thick wall part. For this reason, the oil pan 29 can be lighter-weight and thus the water cooling device 57 can be lighter-weight.

In addition, the first end 68 and the second end 69 of the tube 67 are both connected to the oil pan 29 including the cooling water jacket 58, the oil pan 29 and the tube 67 can be unitized. Thus, in assembly of the water cooling device 57, the oil pan 29 and the tube 67 can be assembled as a unit to another component. Therefore, the water cooling device 57 can be assembled more easily than when the oil pan 29 and the tube 67 are assembled to the component separately.

As described before, the second cooling water passage 71 for communicating the second end 69 of the tube 67 with the internal combustion engine 12 can be defined in the second tube 72.

In general, a tube occupies a small space. Thus, a large workspace can be provided around the second tube 72. Therefore, attachment and detachment of the internal combustion engine 12 to and from the case 10 with fasteners can be easily performed. Also, the second tube 72 can be removable from the guide exhaust 23 of the case 10.

Thus, when the second tube 72 is removed from the guide exhaust 23 of the case 10, the workspace can be increased. Then, the attachment and detachment of the engine 12 can be performed more easily.

As described before, the water guide passage 79 for guiding, to the outside of the oil pan 29, the cooling water 60 leaked from the communication passage 76 into the gap between the mating faces of the guide exhaust 23 and the oil pan 29 can be formed in at least one of the mating faces.

Thus, even if the cooling water 60 leaks from the communication passage 76, the cooling water 60 can be discharged to the outside of the oil pan 29 through the water guide passage 79. Therefore, the cooling water 60 leaked as described above can be prevented from mixing into the lubricating oil 28 in oil storage section 43 of the oil pan 29.

The above description can be based on the illustrated example. The upper case 24 and the oil pan 29 may be formed integrally with each other. The first part 51 and the second part 52 of the inside bottom of the oil pan 29 may be formed in a stepwise fashion. The tubes 67 and 72 may be made of a metal. The joints for the tube 67 may be formed integrally with the oil pan 29.

In the illustrated example, the cooling fins 63 are formed on the lower surface of the bottom of the oil pan 29 and located inside the cooling water jacket 58. However, the cooling fins 63 may be formed integrally with the inside bottom of the oil pan 29 or on both the lower surface of the bottom and the inside bottom of the oil pan 29.

The remaining drawings show additional embodiments. These additional embodiments can have many features and/or components in common with the embodiments described above with reference to FIGS. 1-6. Therefore, those parts corresponding to the components in the first embodiment are identified with the same reference numerals in the drawings and their description is omitted; the differences are described below. The configurations of the parts of the embodiments may be combined in various ways in the light of the goals of the present inventions.

Figure 7:
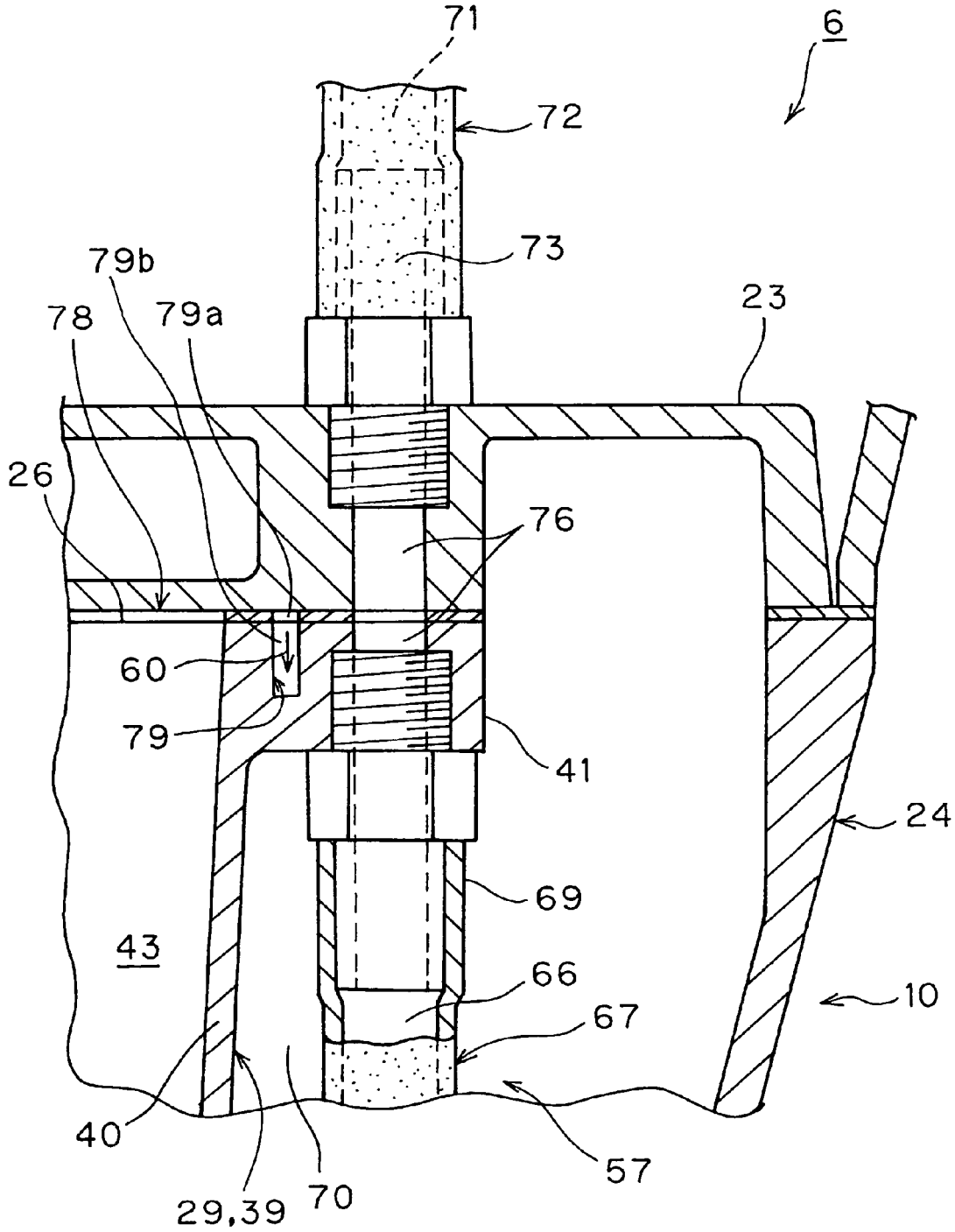
FIG. 7 shows a second embodiment, illustrating a view corresponding to FIG. 5.
Figure 8:
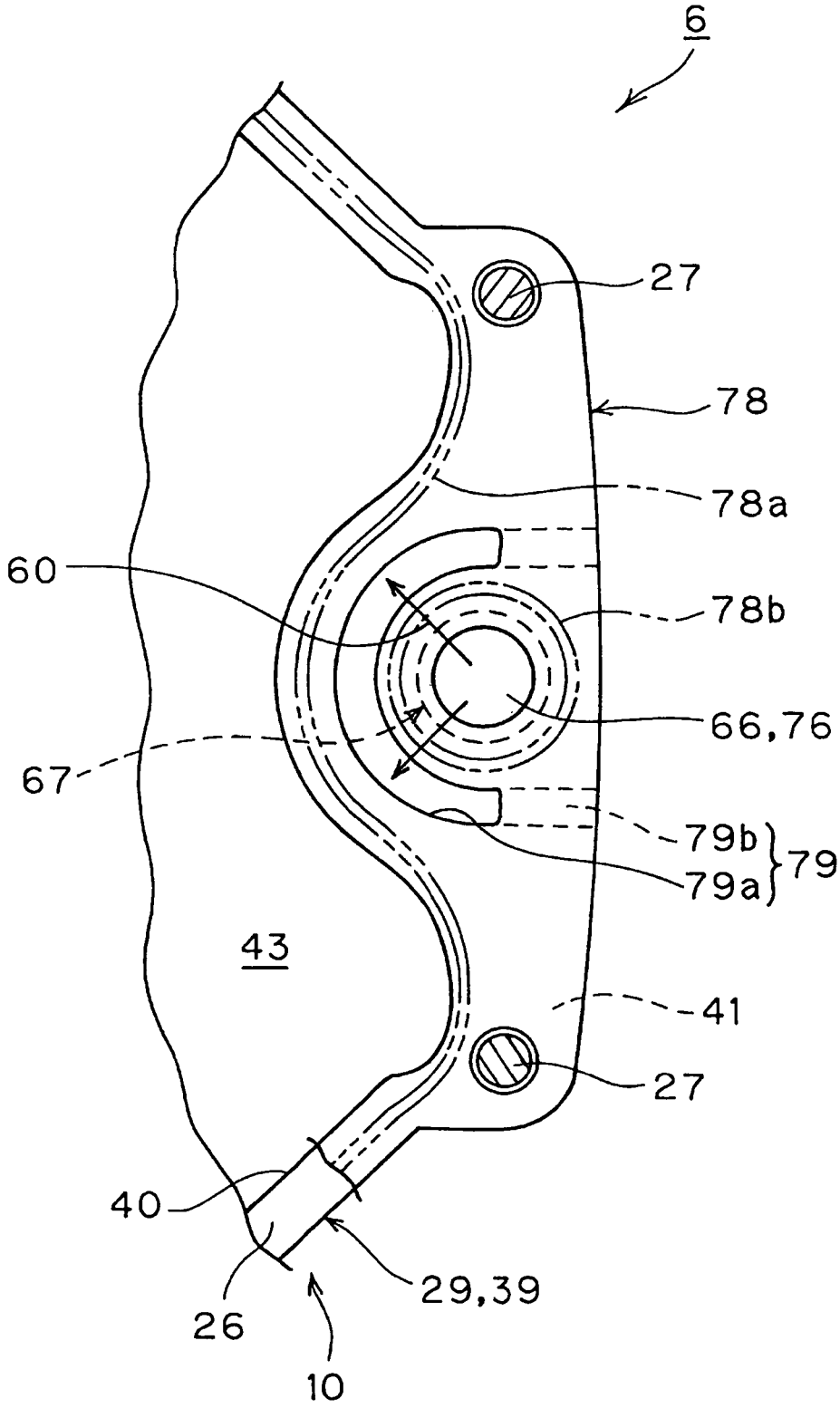
FIG. 8 shows the second embodiment, illustrating a view corresponding to FIG. 6.

As shown in FIGS. 7 and 8, a water guide groove 79*b* forming the water guide passage 79 can be formed in the part of the mating face of the outward flange 41 radially outside and in the vicinity of the communication passage 76 in such a manner that it appears to surround the communication passage 76 as seen from the oil storage section 43 side. A part of the water guide hole 79*a* of the gasket 78 and a part of the water guide groove 79*b* can be of the same size and can be shaped and located at the same position as viewed in a plan view. The longitudinal ends of the water guide groove 79*b* open toward the outside of the oil pan 29. The water guide groove 79*b* may be formed in the mating face of the guide exhaust 23.

Figure 9:
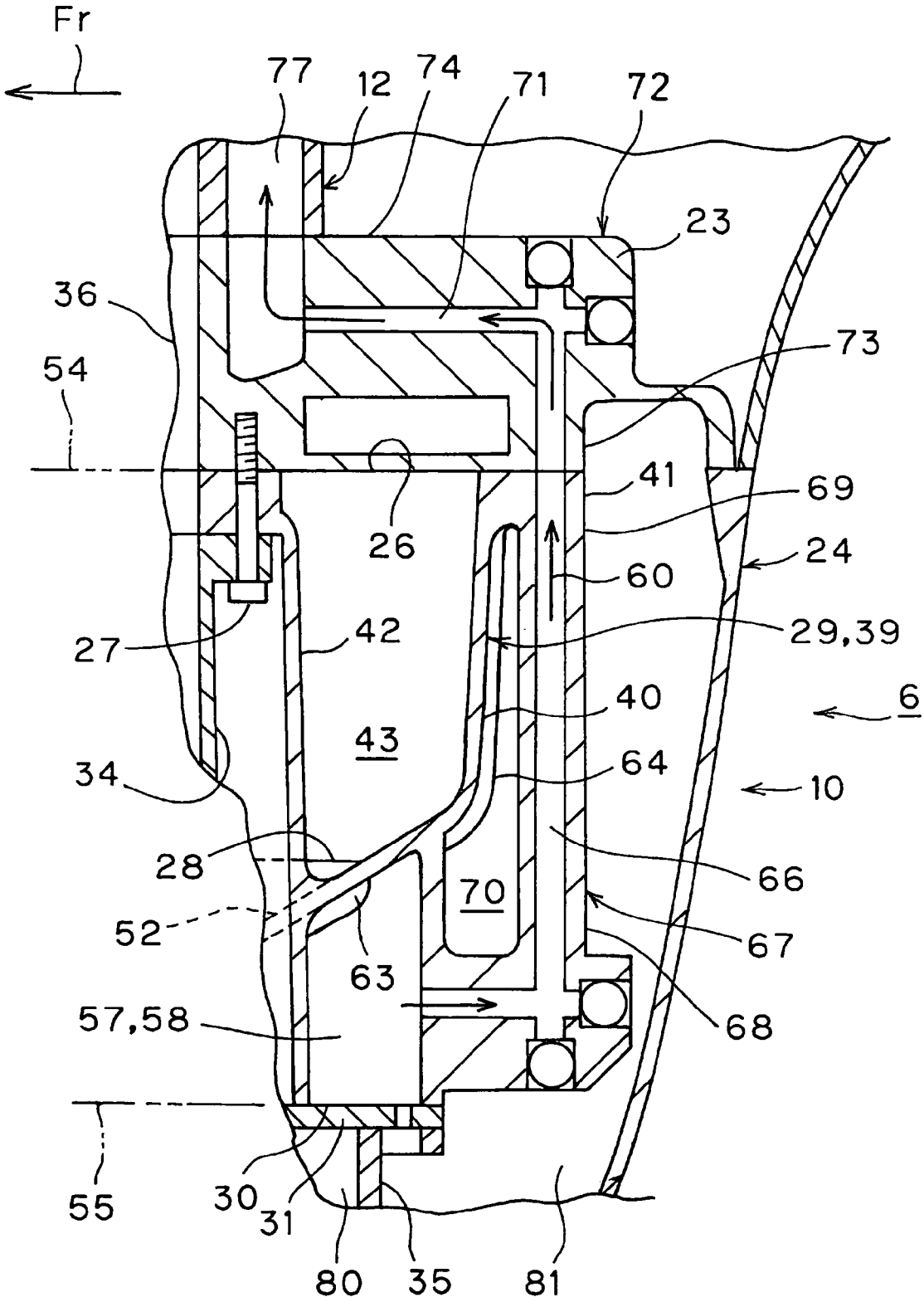
FIG. 9 shows a third embodiment, illustrating a view corresponding to a part of FIG. 1.

As shown in FIG. 9, the cooling water passage 66 can be formed in the oil pan 29. In the oil pan 29, a space 70 can be formed between the oil storage section 43 and the cooling water passage 66. That can be, the space 70 can be formed between the outer wall of the main body of the oil pan 29 defining the oil storage section 43 and the cooling water passage 66.

According to the, above configuration, the number of the water cooling device 57 can be reduced. Therefore, the structure of the water cooling device 57 can be simple and the assembly of the water cooling device 57 can be accomplished easily.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A water cooling device for an outboard motor comprising a case configured to be supported by a hull, an internal combustion engine supported on an upper end of the case, an oil pan formed in the case for storing lubricating oil for the internal combustion engine, a cooling water jacket disposed in thermal communication with the oil pan, and a cooling water passage disposed outside the oil pan and configured for communicating the cooling water jacket with the internal combustion engine, wherein the cooling water jacket is formed on the bottom of the oil pan and a space is formed between at least a part of an outer wall of the oil pan and a portion of the cooling water passage extending adjacent to the part of the outer wall.

2. A water cooling device for an outboard motor comprising a case configured to be supported by a hull, an internal combustion engine supported on an upper end of the case, an oil pan formed in the case for storing lubricating oil for the internal combustion engine, a cooling water jacket disposed in thermal communication with the oil pan, and a cooling water passage for communicating the cooling water jacket with the internal combustion engine, wherein the cooling water jacket is formed on the bottom of the oil pan and a space is formed between at least a part of an outer wall of the oil pan and the cooling water passage, fUrther comprising a water pump driven to supply cooling water to the internal combustion engine through the cooling water passage and which is located in front of the oil pan, wherein the cooling water passage is located behind the oil pan.

3. The water cooling device for an outboard motor of claim 2, wherein the case includes a guide exhaust forming the top part thereof and having an upper surface for supporting the internal combustion engine thereon and a lower surface to which an upper end surface of the oil pan is joined, and a communication passage for communicating the cooling water passage with the internal combustion engine is formed across an upper end part of the oil pan and the guide exhaust, and a water guide passage for guiding cooling water leaked from the communication passage into a gap between the mating faces of the guide exhaust and the oil pan to the outside of the oil pan is formed in at least one of the mating faces.

4. A water cooling device for an outboard motor comprising a case configured to be supported by a hull, an internal combustion engine supported on an upper end of the case, an oil pan formed in the case for storing lubricating oil for the internal combustion engine, a cooling water jacket disposed in thermal communication with the oil pan, and a cooling water passage for communicating the cooling water jacket with the internal combustion engine, wherein the cooling water jacket is formed on the bottom of the oil pan and a space is formed between at least a part of an outer wall of the oil pan and the cooling water passage, wherein the cooling water passage is formed by a tube having first and second ends connected to the cooling water jacket and an upper end part of the oil pan, respectively.

5. The water cooling device for an outboard motor of claim 4, wherein a second cooling water passage for communicating the second end of the tube with the internal combustion engine is formed by a second tube.

6. The water cooling device for an outboard motor of claim 4, wherein the case includes a guide exhaust forming the top part thereof and having an upper surface for supporting the internal combustion engine thereon and a lower surface to which an upper end surface of the oil pan is joined, and a communication passage for communicating the cooling water passage with the internal combustion engine is formed across an upper end part of the oil pan and the guide exhaust, and a water guide passage for guiding cooling water leaked from the communication passage into a gap between the mating faces of the guide exhaust and the oil pan to the outside of the oil pan is formed in at least one of the mating faces.

7. A water cooling device for an outboard motor comprising a case configured to be supported by a hull, an internal combustion engine supported on an upper end of the case, an oil pan formed in the case for storing lubricating oil for the internal combustion engine, a cooling water jacket disposed in thermal communication with the oil pan, and a cooling water passage for communicating the cooling water jacket with the internal combustion engine, wherein the cooling water jacket is formed on the bottom of the oil pan and a space is formed between at least a part of an outer wall of the oil pan and the cooling water passage, wherein the case includes a guide exhaust forming the top part thereof and having an upper surface for supporting the internal combustion engine thereon and a lower surface to which an upper end surface of the oil pan is joined, and a communication passage for communicating the cooling water passage with the internal combustion engine is formed across an upper end part of the oil pan and the guide exhaust, and a water guide passage for guiding cooling water leaked from the communication passage into a gap between the mating faces of the guide exhaust and the oil pan to the outside of the oil pan is formed in at least one of the mating faces.

8. A water cooling device for an outboard motor comprising a case configured to be supported by a hull, an internal combustion engine supported on an upper end of the case, an oil pan formed in the case for storing lubricating oil for the internal combustion engine, a cooling water jacket disposed in thermal communication with the oil pan, and a cooling water passage for communicating the cooling water jacket with the internal combustion engine, wherein the cooling water jacket is formed on the bottom of the oil pan and a space is formed between at least a part of an outer wall of the oil pan and the cooling water passage, wherein the cooling water passage is formed in the oil pan.

9. A water cooling device for an outboard motor comprising a case configured to be supported by a hull, an internal combustion engine supported on an upper end of the case, an oil pan formed in the case for storing lubricating oil for the internal combustion engine, and means for liquid-cooling only the bottom of the oil pan with water flowing upwardly from a water pump.

* * * * *

UNITED STATES PATENT AND TRADEMARK OFFICE

CERTIFICATE OF CORRECTION

PATENT NO. : 7,409,930 B2
APPLICATION NO. : 11/350349
DATED : August 12, 2008
INVENTOR(S) : Mitsuru Nagashima It is certified that error appears in the above-identified patent and that said Letters Patent is hereby corrected as shown below:

In Column 1, Line 33, after "thereby," please delete ",".

In Column 2, Line 59 (approx.), please delete "EMBODIMENT" and insert -- EMBODIMENTS --, therefor.

In Column 3, Line 56, please delete "exhaust,device" and insert -- exhaust device --, therefor.

In Column 4, Line 60, please delete "40" and insert -- 10 --, therefor.

In Column 5, Line 19 (approx.), please delete "hole." and insert -- hole --, therefor.

In Column 5, Line 19 (approx.), please delete "oil." and insert -- oil --, therefor.

In Column 5, Line 27 (approx.), please delete "pap" and insert -- pan --, therefor.

In Column 9, Line 61 (approx.), please delete "the," and insert -- the --, therefor.

UNITED STATES PATENT AND TRADEMARK OFFICE

CERTIFICATE OF CORRECTION

PATENT NO. : 7,409,930 B2
APPLICATION NO. : 11/350349
DATED : August 12, 2008
INVENTOR(S) : Mitsuru Nagashima It is certified that error appears in the above-identified patent and that said Letters Patent is hereby corrected as shown below:

In Column 10, Line 43, In Claim 2, please delete "fUrther" and insert

-- further --, therefor.

Signed and Sealed this

Fourteenth Day of April, 2009

John Doll

JOHN DOLL
*Acting Director of the United States Patent and Trademark Office*